United States Patent [19]

Ogawa et al.

[11] Patent Number: 4,774,168

[45] Date of Patent: Sep. 27, 1988

[54] METHOD FOR FORMING COLOR IMAGE WITH A COLOR DEVELOPER NOT CONTAINING BENZYL ALCOHOL

[75] Inventors: Tadashi Ogawa; Yasuhito Momoki, both of Kanagawa, Japan

[73] Assignee: Fuji Photo Film Co., Ltd., Kanagawa, Japan

[21] Appl. No.: 7,207

[22] Filed: Jan. 27, 1987

[30] Foreign Application Priority Data

Jan. 24, 1986 [JP] Japan ..... 61-14544

[51] Int. Cl.[4] ..... G03C 7/16

[52] U.S. Cl. ..... 430/383; 430/505; 430/567

[58] Field of Search ..... 430/464, 467, 372, 380, 430/432, 376, 393, 567, 569, 493, 505, 383

[56] References Cited

U.S. PATENT DOCUMENTS

| | | | |
|---|---|---|---|
| 3,996,054 | 12/1976 | Santemma et al. | 430/377 |
| 4,035,188 | 7/1977 | Yabata et al. | 430/467 |
| 4,299,914 | 11/1981 | Fujumatsu et al. | 430/552 |
| 4,304,844 | 12/1981 | Fujumatsu et al. | 430/552 |
| 4,366,233 | 12/1982 | Nakamara et al. | 430/505 |
| 4,443,536 | 4/1984 | Lestina | 430/552 |
| 4,446,226 | 5/1984 | Yamashita et al. | 430/567 |
| 4,521,507 | 6/1985 | Iijima et al. | 430/502 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,558,000 | 12/1985 | Yamagami et al. | 430/504 |
| 4,564,590 | 1/1986 | Saraki et al. | 430/552 |
| 4,564,591 | 1/1986 | Tanaka et al. | 430/567 |
| 4,565,777 | 1/1986 | Ogawa et al. | 430/552 |
| 4,590,155 | 5/1986 | Klotzer | 430/567 |
| 4,639,410 | 1/1987 | Mochizuki et al. | 430/506 |

FOREIGN PATENT DOCUMENTS

| | | | |
|---|---|---|---|
| 211437 | 2/1987 | European Pat. Off. . | |
| 29461 | 8/1974 | Japan . | |
| 52058 | 4/1980 | Japan . | |
| 200037 | 12/1982 | Japan . | |
| 31334 | 2/1983 | Japan . | |
| 50536 | 3/1983 | Japan . | |
| 42045 | 3/1983 | Japan . | |
| 48755 | 3/1984 | Japan . | |
| 174836 | 10/1984 | Japan . | |
| 177553 | 10/1984 | Japan . | |
| 177554 | 10/1984 | Japan . | |
| 177555 | 10/1984 | Japan . | |
| 177556 | 10/1984 | Japan . | |
| 177557 | 10/1984 | Japan . | |
| 178459 | 10/1984 | Japan . | |
| 19140 | 1/1985 | Japan . | |
| 26338 | 2/1985 | Japan . | |
| 26339 | 2/1985 | Japan . | |
| 158446 | 8/1985 | Japan | 430/464 |
| 162256 | 8/1985 | Japan . | |
| 158444 | 8/1985 | Japan . | |
| 172042 | 9/1985 | Japan . | |
| 70552 | 4/1986 | Japan . | |
| 30250 | 2/1987 | Japan . | |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method for forming a color image is disclosed, comprising imagewise exposing a color photographic material containing a reflective support having thereon at least one blue-sensitive silver halide emulsion having substantially no iodide content and associated with a yellow dye-forming coupler, at least one green-sensitive silver halide emulsion layer having substantially no iodide content and associated with a magenta dye-forming coupler and at least one red-sensitive silver halide emulsion layer having substantially no iodide content and associated with a cyan dye forming coupler wherein at least one said blue-sensitive emulsion layer, at least one said green-sensitive emulsion layer and at least one said red-sensitive emulsion layer each contains said silver halide in a ratio of from 1/1 to 4.5/1 moles with respect to the color forming coupler and said photographic material has a total coverage of silver halide contained in all of said silver halide emulsion layers being controlled to 0.78 $g/m^2$ or less on a silver basis; and after imagewise exposure, developing the resulting material within 2 minutes and 30 seconds with a color developing solution containing substantially no benzyl alcohol.

23 Claims, No Drawings

METHOD FOR FORMING COLOR IMAGE WITH A COLOR DEVELOPER NOT CONTAINING BENZYL ALCOHOL

FIELD OF THE INVENTION

The present invention relates to a method for forming a color image, and more particularly to a method for forming a color image which enables rapid processing by efficient color formation using silver at a reduced coverage.

BACKGROUND OF THE INVENTION

A method has been known for forming color images, in which three kinds of couplers, viz., yellow, magenta, and cyan, are incorporated into light-sensitive layers, respectively, and after imagewise exposure the light-sensitive layers are processed with a color developing solution containing an aromatic primary amine color developing agent, the oxidation product of which can undergo the coupling reaction with couplers to produce developed colors. Therein, it is important to make a light-sensitive material, which contains silver halide at the least possible coverage, and develop colors at a high efficiency in a limited development time.

In order to effect the color development at a high efficiency, firstly it is necessary to force the development of silver halides to completion as rapidly as possible, and secondly it is desired that silver halide grains to be developed are developed to the last grain. In addition, it is important to cause substantially all of the oxidized color developing agent, which has been generated by the development fulfilling the above-described condition, to undergo the reaction with color couplers. As a means for filling the above-described requirements, it is known to employ silver halides capable of being developed at a high speed and a high rate. In practice, silver chloride and silver chlorobromide emulsions have been employed in some cases. Also, it is known that in other cases where such silver halides cannot be used for some reason an acceleration of development and elevation of developing efficiency can be achieved by increasing a coverage ratio of silver halide to color couplers. Further, it is effective to employ couplers having a high coupling speed, and also to enhance developing activity of a color developing solution itself.

In order to increase a rate of development and a color developing speed of a color developing solution, various methods have so far been employed. One such method consists of using an additive capable of accelerating color formation by speeding up penetration of a color developing agent into oil droplets of coupler dispersions, because it is essential at the final stage of forming dyes by coupling with couplers that a color developing agent itself is incorporated in oil droplets in which the couplers are dispersed. As such an additive, various compounds have been known, especially benzyl alcohol, due to its great effect upon acceleration of color formation. Therefore, benzyl alcohol has so far been used in the development-processing of various kinds of color photographic materials, and at present it is used prevailingly in processing color paper.

Benzyl alcohol, though dissolved in water to some extent, is poor in solubility, so the combined used with diethylene glycol, triethylene glycol, or an alkanolamine has been widely carried out in order to increase the solubility.

However, these compounds and benzyl alcohol itself tend to cause environmental pollution, as indicated by high BOD (biochemical oxygen demand) and COD (chemical oxygen demand) values. Accordingly, it has been desired to reduce the content of benzyl alcohol or to remove benzyl alcohol from the standpoint of disposal of waste water, even though it has an advantage of enhancing color formability, solubility, or so on.

Moreover, the solubility of benzyl alcohol is not yet sufficient even when the above-described solvent, such as diethylene glycol or the like, is used together, so the insufficiency of benzyl alcohol in solubility is responsible for much time and trouble required in preparing a developing solution.

In addition, benzyl alcohol brought into the bath subsequent to the developing bath, namely a bleaching bath or a bleach-fix bath, together with other ingredients of a developing solution, and accumulated therein, is one of the causes of conversion of cyan dyes of some types into the corresponding leuco compounds, to result in lowering of color density of the developed image. Furthermore, accumulated benzyl alcohol tends to cause insufficient washing-out of ingredients of a developing solution, particularly a color developing agent, in the washing step, and these residual ingredients result sometimes in deterioration of image-keeping quality.

From these various points of view, reduction or removal of benzyl alcohol from a color developing solution has great significance. Various methods have been proposed to reduce the amount of benzyl alcohol. For example, Japanese Patent Application (OPI) No. 162256/85 (the term "OPI" as used herein means an "unexamined published application") proposes a method wherein a color development processing is carried out by using a 3-anilino-5-pyrazolone type magenta coupler containing a mercapto group as an eliminable group at a temperature of 33° C. for 3 minutes and 30 seconds. In the examples of the above cited reference, a color photographic light-sensitive material in which a total coverage of silver halide contained in silver halide emulsion layers is 0.77 $g/m^2$ on a silver basis, and a molar ratio of the silver halide with respect to a yellow coupler of a blue-sensitive emulsion layer is 5/1 is used.

In the case of using such a photographic light-sensitive material, there is a problem that when a development processing is carried out by using a developing solution containing 0 ml or less than 2 ml/l of benzyl alcohol, it is difficult to obtain a sufficient color density.

Besides struggling with these problems at present, color laboratories have been under constant pressure to shorten processing time in order to keep pace with the trend of reducing the time limit for delivering over finished prints.

However, conventional arts cannot satisfy all the foregoing requirements at the same time. If the developing time is shortened in addition to removing benzyl alcohol, it is quite obvious that a significant drop in color density of the developed image is caused thereby.

SUMMARY OF THE INVENTION

Therefore, an object of the present invention is to provide a method for forming a color image which causes a reduced drop in color density of the developed image even when development-processing is finished in a short time using a color developing solution containing substantially no benzyl alcohol. Further objects of the present invention are to provide a color photographic material which can develop colors at high efficiency even under the above-described particular processing condition, and to provide a method for forming a color image using said color photographic material.

The above-described objects are attained by a method for forming a color image which comprises imagewise exposing a color photographic material containing a reflective support having thereon at least one blue-sensitive silver halide emulsion having substantially no iodide content and associated with a yellow dye-forming coupler, at least one green-sensitive silver halide emulsion layer having substantially no iodide content and associated with a magenta dye-forming coupler and at least one red-sensitive silver halide emulsion layer having substantially no iodide content and associated with a cyan dye forming coupler wherein at least one said blue-sensitive emulsion layer, at least one said green-sensitive emulsion layer and at least one said red-sensitive emulsion layer each contains said silver halide in a ratio of from 1/1 to 4.5/1 moles with respect to the color forming coupler and said photographic material has a total coverage of silver halide contained in all of said silver halide emulsion layers being controlled to 0.78 g/m$^2$ or less on a silver basis; and after imagewise exposure, developing the resulting material within 2 minutes and 30 seconds with a color developing solution containing substantially no benzyl alcohol.

DETAILED DESCRIPTION OF THE INVENTION

The expression "silver halide emulsion having substantially no iodide content" as used in the present invention is intended to include silver bromide and silver chlorobromide emulsions having a silver iodide content of 2 mol % or less, preferably 0.5 mol % or less, and particularly preferably zero mol %. Preferred silver halide emulsions which can be employed in the present invention are silver chlorobromide emulsions having a bromide content within the range of 20 to 98 mol %. For the purpose of the rapid processing, silver halide emulsions are a silver chloride emulsion or a silver chlorobromide emulsion having a chloride content of more than 80 mol %, preferably more than 90 mol %.

The expression "color developing solution containing substantially no benzyl alcohol" as used in the present invention is intended to include developing solutions containing benzyl alcohol in amounts of not more than 0.5 ml per liter thereof, preferably those not containing benzyl alcohol at all.

In at least one emulsion layer of the color photographic material to be employed in the present invention, it is necessary for the molar ratio of the silver halide to the color coupler to range from 1/1 to 4.5/1, although the molar ratio between the above-described components ranges from 3/1 to 6/1 in various conventional color photographic materials, particularly in color paper, in order to make them develop colors up to practically sufficient densities, taking into account the stoichiometric equivalency of color couplers, namely 2 or 4 in usual cases. The range of the molar ratio in the present invention lies somewhat lower than the conventional one. Accordingly, the molar ratio in the present invention ranges more preferably from 1.5/1 to 3.5/1, and most preferably from 2/1 to 3/1.

The total coverage of silver halides in the color photographic material of the present invention is controlled to 0.78 g/m$^2$ or less, and preferably 0.72 g/m$^2$ or less, on a silver basis. This means the sum of silver coverages of all emulsion layers, typically including a red-sensitive layer, a green-sensitive layer, and a blue-sensitive layer. The individual layers may have any silver coverage, provided that the total silver coverage meets the above-described condition. However, a silver coverage in the range of from 0.1 to 0.4 g/m$^2$ is preferable for each light sensitive layer. When two or more layers having the same color sensitivity constitute one light-sensitive layer, any silver coverage will do as to each constituent layer, so long as the sum of silver coverages of the individual constituent layers is within the range of from 0.1 to 0.4 g/m$^2$. The most preferable silver coverage of each light-sensitive layer ranges from 0.15 to 0.35 g/m$^2$.

The emulsion to be employed in the present invention may be a polydispersed system or a monodispersed system, and a mean grain size thereof may be large or small. However, a monodispersed emulsion having a variation coefficient of 0.2 or less and a mean grain size of from 0.2 to 1.5 microns, or a mixture of two or more of such monodispersed emulsions is preferred as the silver halide emulsion of the present invention. A more preferred emulsion in the present invention is one which has a variation coefficient of 0.15 or less. More specifically, the preferred range of a mean grain size of green-sensitive silver halide monodispersed emulsion and red-sensitive silver halide monodispersed emulsion is 0.2 to 0.6 microns, and that of blue-sensitive silver halide monodispersed emulsion is 0.6 to 1.3 microns.

The interior and the surface of silver halide grains which can be employed in the invention may differ in halide composition, the silver halide grains may have a conjunction structure or a multilayer structure, or the silver halide grains may be uniform throughout. The silver halide grains of the above-described kinds may be present as a mixture.

The silver halide grains of the invention may have a core/shell structure.

The silver halide grains to be employed in the present invention may have a regular crystal form, such as cubic, octahedral, dodecahedral or a tetradecahedral, or an irregular crystal form, such as spherical, etc. Also, the grains may be a composite of various crystal forms. In particular, cubic and tetradecahedral crystal forms are preferred over others. Moreover, the grains may have a tabular form in which the diameter is greater than the thickness by a factor of 5 or more, and particularly 8 or more. An emulsion which contains tabular grains as described above in a fraction of 50% or more on a basis of the total projection area of the whole grains therein may be employed. An emulsion which contains silver halide grains having various kinds of crystal forms as a mixture may be employed. These various kinds of emulsions may be either those which form latent image predominantly at the surface of the grains, or those which mainly form latent image inside the grains, with the former being preferred.

The photographic emulsions to be employed in the present invention can be prepared using various methods as described, e.g., in P. Glafkides, *Chimie et Physique Photographique,* Paul Montel, (1967); G. F. Duffin, *Photographic Emulsion Chemistry,* The Focal Press, (1966); V. L. Zelikman, et al, *Making and Coating Photographic Emulsion,* The Focal Press, (1964), and so on. More specifically, any process, e.g., the acid process, the neugral process, the ammoniacal process, etc., can be employed. Suitable methods for reacting a water-soluble silver salt with a water-soluble halide include, e.g., a single jet method, a double jet method, or a combination thereof. Also, a method in which silver halide grains are produced in the presence of excess silver ion (the so-called reverse mixing method) can be employed. Moreover, the so-called controlled double jet method, in which the pAg of the liquid phase in which silver halide grains are to be precipitated is maintained constant, may be employed. According to this method, silver halide emulsions having a regular crystal form and a substantially uniform grain size can be obtained.

In addition, an emulsion prepared by a so-called conversion method, which comprises a step of converting the silver halide already formed to silver halide having a smaller solubility product during the period up to the conclusion of silver halide grain formation, and an emulsion which has received a halogen replacement treatment after the conclusion of silver halide grain formation can be employed.

In a process for producing silver halide grains or allowing the produced silver halide grains to ripen physically, cadmium salts, zinc salts, lead salts, thallium salts, iridium salts or complexes, rhodium salts or complexes, iron salts or complexes, and the like may be present.

After grain formation, the silver halide emulsions are, in general, ripened physically, desalted, ripened chemically, and then coated.

Upon precipitation, physical ripening or chemical ripening, known silver halide solvents (such as ammonia, potassium thiocyanate, thioethers and thione compounds (e.g., those described in U.S. Pat. Nos. 3,271,157, Japanese Patent Application (OPI) Nos. 12360/76, 82408/78, 144319/78, 100717/79 and 155828/79, and so on) can be used. Removal of soluble silver salts from the physically ripened emulsions can be achieved according to a noodle washing method, a flocculation method, an ultrafiltration method, etc.

The silver halide emulsions to be employed in the present invention are chemically sensitized using a sulfur sensitization method which utilizes active gelatin or a sulfur-containing compound capable of reacting with silver ion (e.g., thiosulfates, thioureas, mercapto compounds, rhodamines, etc.), a reduction sensitization method which utilizes a reducing material (e.g., stannous salts, amines, hydrazine derivatives, formamidinesulfinic acid, silane compounds, etc.), a noble metal sensitization method which utilizes a metal compound (e.g., gold complex salts, complex salts of Group VIII metals such as Pt, Ir, Pd, Rh, Fe, etc.) individually or as a combination thereof.

Of the foregoing chemical sensitizations, the method of conducting sulfur sensitization alone is more preferable in the present invention.

In order to satisfy the gradation aimed at by the color photographic material of the present invention, two or more monodispersed silver halide emulsions having substantially the same color sensitivity but differing in grain size (preferably those having a variation coefficient within the above-described range) can be coated in a single layer as a mixture, or they can be coated separately in a multilayer. Also, two or more polydispersed silver halide emulsions, or a combination of monodispersed and polydispersed emulsions may be coated as a mixture, or separately in a multilayer.

The blue-sensitive, green-sensitive, and red-sensitive emulsions of the present invention are silver halide emulsions sensitized spectrally using methine dyes or other so as to have the corresponding color sensitives. Suitable dyes which can be used include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any nuclei typically present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline, and like nuclei. Each of these nuclei may also have a substituent group on a carbon atom.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid and like nuclei, as ketomethilene structure-containing nuclei.

These sensitizing dyes may be employed alone or in combination of two or more thereof. In particular, combinations of sensitizing dyes are often employed for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

Materials which can exhibit a supersensitizing effect in combination with a certain sensitizing dye although they themselves do not spectrally sensitize silver halide emulsions or do not absorb light in the visible region may be incorporated into the silver halide emulsions.

It is to be desired that color couplers to be incorporated in the light-sensitive material should be rendered diffusion-resistant by having a ballast group or existing in a polymerized form. Two-equivalent couplers containing an eliminable group at the coupling active site are preferred to four-equivalent couplers in which a hydrogen atom is present at the coupling active site, from the standpoint of saving a silver coverage. In addition, couplers capable of producing dyes of moderate diffusibility by development, colorless couplers, couplers capable of releasing development inhibitors upon coupling reaction (the so-called DIR couplers), and couplers capable of releasing development accelerators can be used.

As typical examples of yellow couplers which can be employed in the present invention include oil-protected acylacetamide couplers. Specific examples of such couplers are described, e.g., in U.S. Pat. Nos. 2,407,210, 2,875,057 and 3,265,506. The couplers used preferably in the present invention are two-equivalent ones, and oxygen elimination type yellow couplers described, e.g., in U.S. Pat. Nos. 3,408,194, 3,447,928, 3,933,501 and 4,022,620, and nitrogen elimination type yellow couplers described, e.g., in Japanese Patent Publication No. 10739/83, U.S. Pat. Nos. 4,401,752 and 4,326,024, *Research Disclosure* RD No. 18053 (Apr. 1979), British Pat. No. 1,425,020, German Patent Application (OLS) Nos. 2,219,917, 2,261,361, 2,329,587 and 2,433,812, and so on can be instanced typically. Of these couplers, α-pivaloylacetanilide type couplers have an advantage in that the dyes produced therefrom by development are excellent in fastness, particularly light fastness, while α-benzoylacetanilide type couplers have an advantage in that color density of images produced therefrom is high.

Examples of magenta couplers which can be employed in the present invention include oil-protected indazolone type couplers, cyanoacetyl type couplers, and, more preferably, couplers of 5-pyrazolone type, and those of pyrazoloazole type like pyrazolotriazoles, etc. Of 5-pyrazolone type couplers, those substituted with an arylamino group or an acylamino group at the 3-position are preferred over others from the standpoint of the hue and color density of the developed image. Typical examples of such couplers are described in U.S. Pat. Nos. 2,311,082, 2,343,703, 2,600,788, 2,908,573, 3,062,653, 3,152,896 and 3,936,015, and so on. Preferred eliminable groups of two-equivalent 5-pyrazolone type couplers include nitrogen type eliminable groups described in U.S. Pat. No. 4,310,619, and arylthio groups described in U.S. Pat. No. 4,351,897. Also, 5-pyrazolone type couplers having ballast groups described in European Pat. No. 73,636 can provide high color density of the developed image.

Examples of pyrazoloazole type couplers include pyrazolobenzimidazoles described in U.S. Pat. No. 3,369,879, and, more preferably, pyrazolo[5,1-c][1,2,4]triazoles described in U.S. Pat. No. 3,725,067, pyrazolotetrazoles described in *Research Disclosure*, RD. No. 24220 (June 1984), and pyrazolopyrazoles described in *Research Disclosure*, RD 24230 (June 1984). Of these couplers, imidazo[1,2-b]pyrazoles described in European Pat. No. 119,741, and, more particularly, pyrazolo[1,2-b][1,2,4]triazoles described in European Pat. No. 119,860 are preferred over others from the viewpoint that dyes produced therefrom by development have slight side absorption in the yellow region and excellent fastness to light.

Cyan couplers which can be used in the present invention include oil-protected couplers of naphthol and phenol types. Representatives of preferred naphthol type couplers are those described in U.S. Pat. No. 2,474,293, especially oxygen elimination type two-equivalent naphthol couplers described in U.S. Pat. Nos. 4,052,212, 4,146,396, 4,288,233 and 4,296,200. Specific examples of phenol type couplers are described, e.g., in U.S. Pat. Nos. 2,369,929, 2,801,171, 2,772,162, 2,895,826, etc. Particularly preferred cyan couplers in the present invention are those excellent in humidity and temperature resistances. Typical examples of such couplers include phenol type cyan couplers having an alkyl group higher than ethyl group at a m-position of the phenol nucleus, which are described in U.S. Pat. No. 3,772,002, the phenol type couplers having acylamino groups at both 2- and 5-positions, which are described, e.g., in U.S. Pat. Nos. 2,772,162, 3,758,308, 4,126,396, 4,334,011, and 4,327,173, German Patent Application (OLS) No. 3,329,729, Japanese Patent Application (OPI) No. 166956/84, and so on, and the phenol type couplers having a phenylureido group at the 2-position and an acylamino group at the 5-position, which are described in U.S. Pat. Nos. 3,446,622, 4,333,999, 4,451,559 and 4,427,767, and so on.

Granularity of images can be improved by the combined use with couplers which can produce dyes having moderate diffusibility by development. Specific examples of diffusible dye-producing magenta couplers are described in U.S. Pat. No. 4,366,237 and British Pat. No. 2,125,570, and those of diffusible dye-producing yellow, magenta and cyan couplers are described in European Pat. No. 96,570 and German Patent Application (OLS) No. 3,234,533.

The dye-forming couplers and the above-described special couplers may take a polymeric form (including a dimeric form). Typical examples of polymerized dye-forming couplers are described in U.S. Pat. Nos. 3,451,820 and 4,080,211. Typical examples of polymerized magenta couplers are described in British Pat. No. 2,102,173 and U.S. Pat. No. 4,367,282.

In order to satisfy the characteristics required of the light-sensitive material, two or more of various couplers to be employed in the present invention can be incorporated together into the same light-sensitive layer, or the same coupler can be introduced into two or more of different kinds of layers.

Couplers to be employed in the present invention can be introduced into the light-sensitive material using an oil-in-water dispersion method. In the oil-in-water dispersion method, couplers are dissolved in either a high boiling organic solvent having a boiling point of 175° C. or above, or a so-called auxiliary solvent having a low boiling point, or in a mixture of these solvents, and then dispersed finely into an aqueous medium like water or an aqueous gelatin solution in the presence of a surface active agent. Suitable examples of high boiling organic solvents are described in U.S. Pat. No. 2,322,027, and so on. The dispersion may be accompanied by phase inversion. Further, the auxiliary solvent used may be removed from the dispersion or decreased in content therein through distillation, noodle washing, ultrafiltration or so on, if needed, in preference to coating of the dispersion.

Specific examples of high boiling organic solvents which can be used include phthalic acid esters (e.g., dibutyl phthalate, dicyclohexyl phthalate, di-2-ethylhexyl phthalate, decyl phthalate, etc.), phosphoric or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc.), benzoic acid esters (e.g., 2-ethylhexyl benzoate, dodecylbenzoate, 2-ethylhexyl-p-hydroxybenzoate, etc.), amides (e.g., diethyldodecanamide, N-tetradecylpyrrolidone, etc.), alcohols and phenols (e.g., isostearyl alcohol, 2,4-di-tert-amylphenol, etc.), aliphatic carboxylic acid esters (e.g., azelaic acid dioctyl ester, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffins, dodecylbenzene, diisopropylnaphthalene, etc.), and so on. As for the auxiliary solvents, organic solvents having a boiling point of from about 30° C., and preferably 50° C., to about 160° C. can be used, with typical examples including ethyl acetate, butyl acetate, ethyl propionate, methyl ethyl ketone, cyclohexanone, 2-ethoxyethyl acetate, dimethylformamide, and so on.

Processes and effects of the latex dispersion method, and specific examples of latexes employed as impregnant are described in U.S. Pat. No. 4,199,363, German Patent Application (OLS) Nos. 2,541,274 and 2,541,230, and so on.

The light-sensitive material produced in accordance with the present invention may contain, as a color fog inhibitor or a color mixing inhibitor, hydroquinone derivatives, aminophenol derivatives, amines, gallic acid derivatives, catechol derivatives, ascorbic acid derivatives, colorless couplers, sulfonamidophenol derivatives, or so on.

The light-sensitive material of the present invention can contain known discoloration inhibitors. The representatives of the organic discoloration inhibitors are hydroquinones, 6-hydroxychromanes, 5-hydroxycoumarans, spirochromans, p-alkoxyphenols, hindered phenols including bisphenols as main members, gallic acid derivatives, methylenedioxybenzenes, aminophenols, hindered amines, and ether or ester derivatives obtained by silylating or alkylating a phenolic hydroxyl group of the above-cited compounds each. In addition, metal complex salts represented by (bissalicylaldoximato)nickel complexes and (bis-N,N-dialkyldithiocarbamato)nickel complexes can also be employed as discoloration inhibitors.

On the prevention of deterioration of yellow dye images due to heat, moisture and light, compounds having both hindered amine and hindered phenol moieties in a molecule, as described in U.S. Pat. No. 4,268,593, can produce a desirable effect. In order to prevent magenta dye images from suffering deterioration, particularly due to light, spiroindanes described in Japanese Patent Application (OPI) No. 159644/81, and chromanes substituted with a hydroquinone di- or mono-ether described in Japanese Patent Application (OPI) No. 89835/80 are employed to advantage.

In order to improve on the keeping quality of a cyan image, particularly on light fastness thereof, it is to be desired that a cyan coupler should be used together with an ultraviolet absorbent of the benzotriazole type. Therein, the ultraviolet absorbent and the cyan coupler may be present in a coemulsified condition.

The ultraviolet absorbent is used at a coverage sufficient to impart satisfactory optical stability to the cyan dye image. If added in an excessively large amount, it sometimes causes yellow stain in nonexposed areas (white background) of the color photographic material. Therefore, a suitable coverage of the ultraviolet absorbent is within the range, in general, of from $1\times10^{-4}$ to $2\times10^{-3}$ mol/m$^2$, and particularly preferably from $5\times10^{-4}$ to $1.5\times10^{-3}$ mol/m$^2$.

In a layer structure of generally used color paper, an ultraviolet absorbent is incorporated in either layer, preferably both layers, adjacent to a cyan coupler-containing red-sensitive emulsion layer. When an ultraviolet absorbent is incorporated into an interlayer arranged between a green-sensitive layer and a red-sensitive layer, it may be in a condition of a co-emulsion with a color mixing inhibitor. When an ultraviolet absorbent is incorporated in a protective layer, another protective layer may be provided as the outermost layer. In this outermost layer, a matting agent and the like can be contained.

In the photographic material of the present invention, an ultraviolet absorbent can be incorporated in a hydrophilic colloid layer.

The photographic material of the present invention may further contain water-soluble dyes in its hydrophilic colloid layers as a filter dye, or for various purposes, e.g., prevention of irradiation, antihalation, and so on.

The photographic material of the present invention may contain a whitening agent of stilbene type, triazine type, oxazole type, coumarin type or the like in photographic emulsion layers or some other hydrophilic colloid layers. A whitening agent to be used may be soluble in water, or a water-insoluble whitening agent may be used in a form of dispersion.

The present invention can be applied to a multilayer multicolor photographic material having at least two different color sensitivities on a support, as described hereinbefore. A multilayer color photographic material has, in general, at least one red-sensitive emulsion layer, at least one green-sensitive emulsion layer and at least one blue-sensitive layer on a support. The order of these layers can be varied as desired. Each of the above-described emulsion layers may have two or more constituent layers differing in sensitivity, and a light-insensitive layer may be arranged between any two of the constituent layers having the same color sensitivity.

In addition to the above-described silver halide emulsion layers, it is desired to provide proper auxiliary layers, such as a protective layer, an interlayer, a filter layer, an antihalation layer, a backing layer, and so on, in the photographic material according to the present invention.

Gelatins are used to advantage as binder or protective colloid to be contained in emulsion layers and interlayers of the photographic material of the present invention. Also, hydrophilic colloids other than gelatin can be used.

As examples of hydrophilic colloids which can be used include proteins, such as gelatin derivatives, graft copolymers prepared from gelatin and other high polymers, albumin, casein and the like; sugar derivatives, such as cellulose derivatives including hydroxyethyl cellulose, carboxymethyl cellulose, cellulose sulfate and the like, sodium alginate, starch derivatives and so on; and various kinds of synthetic hydrophilic high polymers including homo- and co-polymers, such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and so on.

Specific examples of gelatins include not only lime-processed gelatin, but also acid-processed gelatin, enzyme-processed gelatin as described in *Bull. Soc. Sci. Phot. Japan,* No. 16, p. 30 (1966), hydrolysis products of gelatin, and enzyme decomposition products of gelatin.

In addition to the foregoing additives, the photographic material of the present invention may contain various stabilizers, stain inhibitors, developers or precursors thereof, development accelerators or precursors thereof, lubricants, mordants, matting agents, antistatic agents, plasticizers, or other various additives useful for a photographic light-sensitive material. Typical examples of such additives are described in *Research Disclosure,* RD No. 17643 (Dec. 1978), and supra, RD No. 18716 (Nov. 1979).

The term "reflective support" as used herein means those which can clarify dye images formed in silver halide emulsion layers by their heightened reflectivity. Such reflective supports include supports coated with hydrophobic resins in which light-reflecting substances, such as titanium oxide, zinc oxide, calcium carbonate, calcium sulfate or the like, are dispersed, and hydrophobic resin films which contain light-reflecting substances in a dispersed condition. Specifically, baryta paper, polyethylene-coated paper, synthetic paper of polypropylene type, and transparent supports, on which a light-reflecting layer is provided or in which a light-reflecting substance is dispersed, including glass plate, polyester films such as polyethylene terephthalate film, cellulose triacetate film, cellulose nitrate film and the like, polyamide film, polycarbonate film, polystyrene film, and so on, can be employed. From supports as set forth above, the support to be used can be selected depending upon the end use purpose of the photographic material.

Processing steps (image-forming process) in the present invention are described below.

The color development step of the present invention is carried out in a short time of below 2 minutes and 30 seconds. A preferred development processing time ranges from 1 minute to 2 minutes and 10 seconds. The term "development processing time" used herein means a period from the start of photographic material's contact with a color developing solution till the start of the contact with the next bath, and is intended to include the time to move the photographic material to the next bath, too.

A color developing solution to be used for development processing of the photographic material of the present invention is an alkaline aqueous solution, preferably containing an aromatic primary amine type color developing agent as a main component. Preferred developing agents of such a type are p-phenylenediamine compounds. The representatives of such compounds include 3-methyl-4-amino-N,N-diethylaniline, 3-methyl-4-amino-N-ethyl-N-β-hydroxy-ethlaniline, 3-methyl-4-amino-N-ethyl-N-β-methanesulfonamidoethylaniline, 3-methyl-4-amino-N-ethyl-N-β-methoxyethylaniline, and sulfates, hydrochlorides or p-toluenesulfonates, tetraphenylborates, p-(t-octyl)benzenesulfonates of the above-cited anilines.

Specific examples of aminophenol derivatives which can be used as color developing agents include o-aminophenol, p-aminophenol, 4-amino-2-methylphenol, 2-amino-3-methylphenyl, 2-oxy-3-amino-1,4-dimethylbenzene, and so on.

In addition to these color developing agents, those described in L. F. A. Mason, *Photographic Processing Chemistry*, pp. 226–229, Focal Press (1966), U.S. Pat. Nos. 2,193,015 and 2,592,364, Japanese Patent Application (OPI) No. 64933/73, and so on may be used. Two or more of color developing agents can be used in combination, if needed.

A processing temperature of the color developing bath in the present invention ranges preferably from 30° C. to 50° C., and more preferably from 35° C. to 45° C.

Various compounds can be employed as development accelerator, save that benzyl alcohol is used only in an unsubstantial amount in the present invention. Examples thereof include various kinds of pyridinium compounds and other cationic compounds, cationic dyes like fenosafranine, and neutral salts like thallium nitrate, potassium nitrate, etc., as described, e.g., in U.S. Pat. No. 2,648,604, Japanese Patent Publication No. 9503/69, and U.S. Pat. No. 3,171,247; polyethylene glycol and derivatives thereof, and nonionic compounds like polythioethers, as described in Japanese Patent Publication No. 9304/69, and U.S. Pat. Nos. 2,533,990, 2,531,832, 2,950,970 and 2,577,127; thioether compounds described in U.S. Pat. No. 3,201,242; and the compounds described in Japanese Patent Application (OPI) Nos. 156934/83 and 220344/85.

In the short-time development processing in accordance with the present invention, not only a means of accelerating development but also the art of preventing developer fog forms an important subject. Examples of antifoggants which can be preferably used in the present invention include halides of alkali metals, such as potassium bromide, sodium bromide, potassium iodide and the like, and organic antifoggants. Specific examples of organic antifoggants which can be used include nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethyl-benzimidazole, hydroxyazaindolizine, etc.; mercapto-substituted heterocyclic compounds, such as 1-phenyl-5-mercaptotetrazole, 2-mercaptobenzimidazole, 2-mercaptobenzothiazole, etc.; and mercapto-substituted aromatic compounds like thiosalicylic acid. Of these antifoggants, halogenides are particularly preferred. These antifoggants may be eluted from the color photographic material during processing, and accumulated in the color developing solution.

The color developing solution can generally contain pH buffering agents, such as carbonates, borates or phosphates of alkali metals; preservatives, such as hydroxylamine, triethanolamine, the compounds described in German Patent Application (OLS) No. 2,622,950, sulfites, and bisulfites; organic solvents like diethylene glycol; dye-forming couplers; competing couplers; nucleating agents like sodium borohydride; auxiliary developers like 1-phenyl-3-pyrazolidones; viscosity imparting agents; and chelating agents, such as aminopolycarboxylic acids the representatives of which are ethylenediaminetetraacetic acid, nitrilotriacetic acid, cyclohexanediaminetetraacetic acid, imidodiacetic acid, N-hydroxymethylethylenediamine triacetic acid, diethylenetriaminepentaacetic acid, triethylenetetraminehexaacetic acid, the compounds described in Japanese Patent Application (OPI) No. 195845/83, organic phosphonic acids such as 1-hydroxyethylidene-1,1'-diphosphonic acid and those described in Research Disclosure, RD No. 18170 (May 1979), aminophosphonic acids such as aminotris(methylenephosphonic acid), ethylenediamine-N,N,N',N'-tetramethylenephosphonic acid, etc., and phosphonocarboxylc acids described in Japanese Patent Application (OPI) Nos. 102726/77, 42730/78, 121127/79, 4024/80, 4025/80, 126241/80, 65955/80 and 65956/80 and *Research Disclosure*, RD No. 18170 (May 1979).

A color developing bath may be divided into two or more parts, if desired. Replenishing of a replenisher for color development may begin at the forefront bath or the final bath, and a reduction in development time and replenishing amounts may be carried out.

After color development, the silver halide color photographic material of the invention is, in general, subjected to a bleach processing. The bleach processing may be carried out simultaneously with fix-processing or separately therefrom.

Suitable examples of bleaching agents which can be used include compounds of polyvalent metals, such as Fe(III), Co(III), Cr(VI), Cu(II), etc., peroxy acids, quinones, nitroso compounds and so on. Representatives of such polyvalent metal compounds are ferricyanides; bichromates; complex salts of Fe(III) or Co(III) and organic acids such as aminopolycarboxylic acids, with specific examples including ethylenediaminetetraacetic acid, diethylenetriaminepentaacetic acid, nitrilotriacetic acid, 1,3-diamino-2-propanol tetraacetic acid, etc., citric acid, tartaric acid, malic acid, and so on; persulfates; manganates; nitrosophenols; and so on. Of these complex salts, potassium ferricyanide, sodium ethylenediaminetetraacetatoferrate(III), ammonium ethylenediaminetetraacetatoferrate(III), ammonium triethylenetetraminepentaacetatoferrate(III) and persulfates are especially useful. In particular, ethylenediaminetetraacetatoferrate(III) complex salts are useful in not only an independent bleach bath, but also a combined bleach and fix bath.

To a bleaching bath or a bleach-fix bath may be added various accelerators in combination with bleaching agents, if desired. For example, not only bromine ion and iodine ion, but also thiourea compounds as described in U.S. Pat. No. 3,706,561, Japanese Patent Publication Nos. 8506/70 and 26586/74, and Japanese Patent Application (OPI) Nos. 32735/78, 36233/78 and 37016/78, thiol compounds as described in Japanese Patent Application (OPI) Nos. 124424/78, 95631/78, 57831/78, 32736/78, 65732/78 and 52534/79, U.S. Pat. No. 3,893,858, and so on, heterocyclic compounds described in Japanese Patent Application (OPI) Nos. 59644/74, 140129/75, 28426/78, 141623/78, 104232/78, 35727/79, and so on, thioether compounds described in Japanese Patent Application (OPI) Nos. 20832/77, 25064/80, 26506/80, and so on, quaternary amines described in Japanese Patent Application (OPI) No. 8444/73, or thiocarbamoyl compounds and others described in Japanese Patent Application (OPI) No. 42349/74 may be used as accelerators.

Examples of fixing agents which can be used include thiosulfates, thiocyanates, thioether compounds, thioureas, and large quantities of iodides. In general, thiosulfates are used to advantage. As preservatives to be employed in a bleach-fix bath or a fixing bath, sulfites, bisulfites or adducts of carbonyl and bisulfites are preferred.

After bleach-fix processing or fix processing, a washing processing is generally carried out. In the step of washing, various known compounds may be added for the purposes of preventing precipitation and saving washing water. In order to prevent the precipitation from occurring, a water softener such as an inorganic phosphoric acid, an aminopolycarboxylic acid, an organic phosphonic acid, or so on; a germicide and a bactericide for inhibiting various bacteria, and waterweeds, from breaking out; a hardener such as a magnesium salt or an aluminium salt; a surface active agent for lightening a drying load and preventing drying marks from generating; and so on can be added, if needed. Also, the compounds described in L. E. West, *Photo. Sci. Eng.*, vol. 9, No. 6 (1965), and so on may be added. In particular, addition of chelating agents and bactericides is effective. Also, saving water becomes feasible by carrying out the washing step using two or more tanks according to the countercurrent washing method.

On the other hand, a multistage countercurrent stabilization-processing step as described in Japanese Patent Application (OPI) No. 8543/82 may be carried out after or in place of the washing step. To the stabilizing bath are added various kinds of compounds in order to stabilize the developed images. Typical examples of such additives include various buffering agents for adjusting pH of the processed film to a proper value, such as borates, metaborates, borax, phosphates, carbonates, potassium hydroxide, sodium hydroxide, aqueous ammonia, monocarboxylic acids, dicarboxylic acids, polycarboxylic acids, etc., and formaldehyde. The stabilizing bath may further contain a water softener (e.g., inorganic phosphoric aids, aminopolycarboxylic acids, organic phosphonic acids, aminopolyphosphonic acids, phosphocarboxylic acids, etc.), a germicide (e.g., proxel, isothiazolone, 4-thiazolylbenzimidazole, halogenophenols, benzotriazoles, etc.), a surface active agent, a brightening agent, a hardener, and so on, if desired.

In addition, various ammonium salts, such as ammonium chloride, ammonium nitrate, ammonium sulfate, ammonium phosphate, ammonium sulfite, ammonium thiosulfate, and the like can be added to the stabilizing bath in order to control the pH in the processed film.

The present invention is illustrated in greater detail by reference to the following examples.

EXAMPLE 1

On a paper support laminated with polyethylene on both sides, were coated photographic constituent layers shown in Table 1 to make a multilayer color photographic paper. Coating compositions used for making the photographic paper were prepared in the following manner.

Preparation of Coating Composition for First Layer:

With 19.1 g of the yellow coupler (a) and 4.4 g of the image stabilizer (b) were admixed 27.2 ml of ethyl acetate and 7.9 ml of the solvent (c). The resulting solution was emulsified and dispersed into 185 ml of a 10% aqueous gelatin solution containing 8 ml of a 10% sodium dodecylbenzenesulfonate. Separately, 90 g of a blue-sensitive emulsion was prepared by adding the blue-sensitive sensitizing dye illustrated below to a silver chlorobromide emulsion (having a bromide content of 80 mol % and containing 70 g of silver per 1 Kg of the emulsion) in an amount of $7.0\times10^{-4}$ mole per 1 mole of silver chlorobromide. The emulsified dispersion and the silver chlorobromide emulsion were mixed and dispersed. Thereto, gelatin was further added so as to adjust a gelatin concentration to the value shown in Table 1. Thus, a coating composition for the first layer was obtained.

Coating compositions for the second to seventh layers were prepared in an analogous manner. In each layer, sodium 1-oxy-3,5-dichloro-s-triazine was employed as a gelatin hardener.

Spectral sensitizers employed in the emulsions respectively are illustrated below.

Blue-sensitive Emulsion Layer

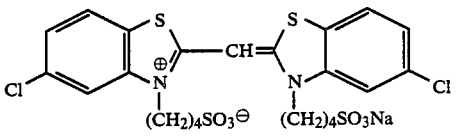

(Amount added: $7.0\times10^{-4}$ mole per mole of silver halide)

Green-sensitive Emulsion Layer

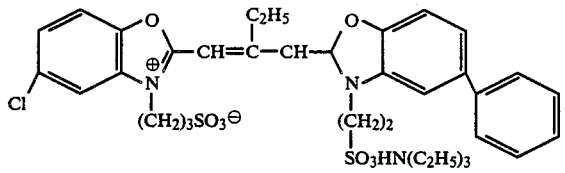

(Amount added: $4.0\times10^{-4}$ mole per mole of silver halide)

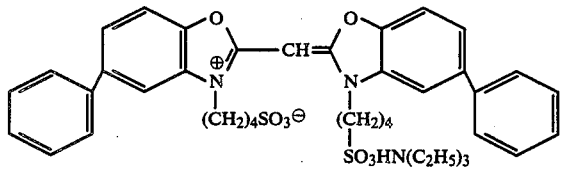

(Amount added: $7.0\times10^{-5}$ mole per mole of silver halide)

Red-sensitive Emulsion Layer

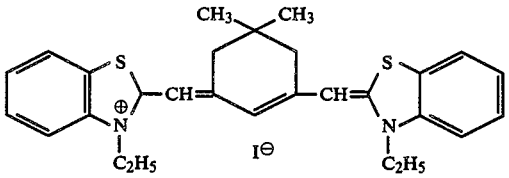

(Amount added: $1.0\times10^{-4}$ mole per mole of silver halide)

The following dyes were incorporated in their respective emulsion layers as an irradiation preventing dye.

Green-sensitive Emulsion Layer

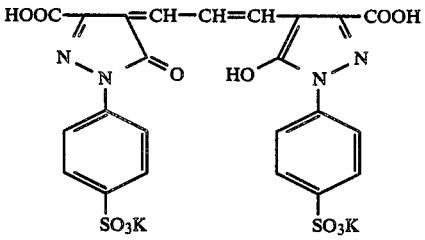

Red-sensitive Emulsion Layer

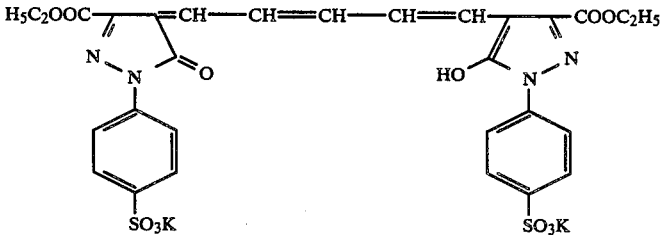

Structural formulae of the ingredients employed in this example, including couplers and others, are illustrated below.

(a) Yellow coupler

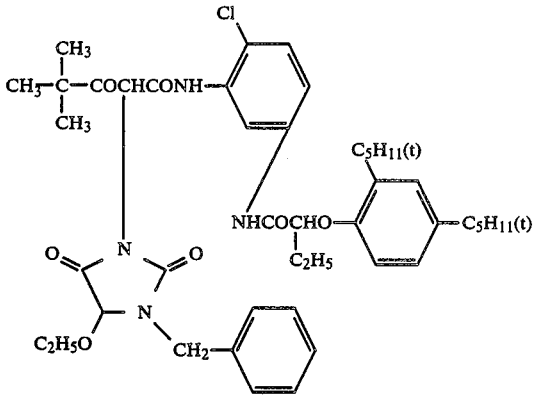

(b) Image Stabilizer

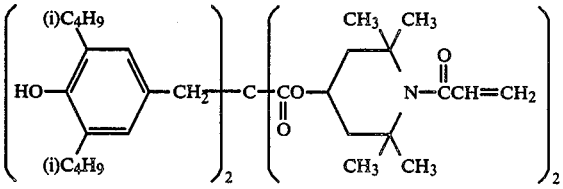

(c) Solvent

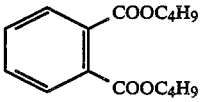

(d) Color-Mixing Inhibitor

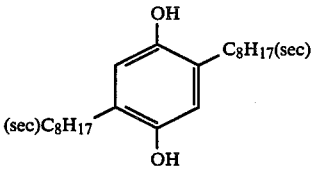

(e) magenta Coupler

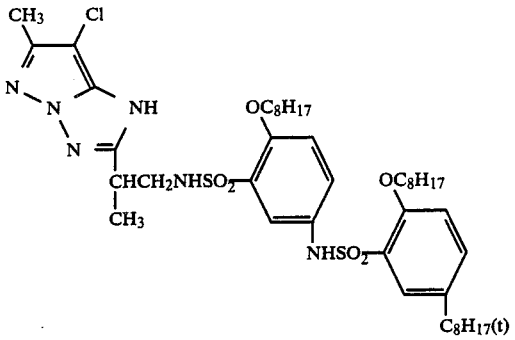
(f) Dye Image Stabilizer
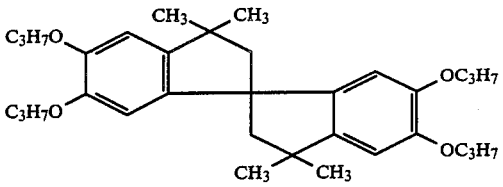
(g) Solvent
2/1 (weight ratio mixture of
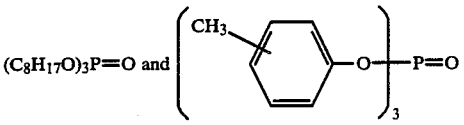
(h) Ultraviolet absorbent
1/5/3 (by mole ratio) mixture of
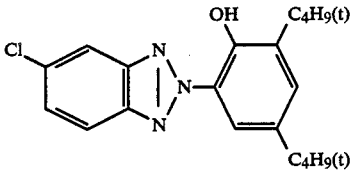
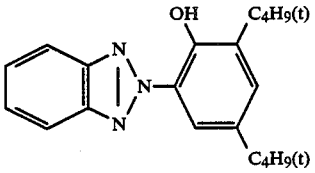
and
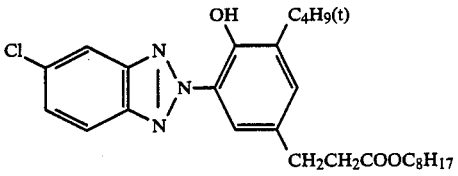
(i) Color-Mixing Inhibitor
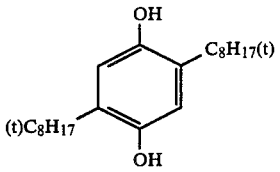
(j) Solvent
$(iso\text{-}C_9H_{13}O)_3P{=}O$
(k) Cyan Coupler
1/1 (mole ratio mixture of
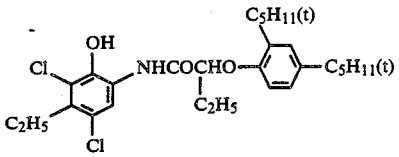
(k1)
and
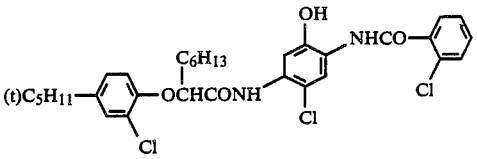
(k2)
(l) Dye Image Stabilizer 1/3/3 (mole ratio) mixture of
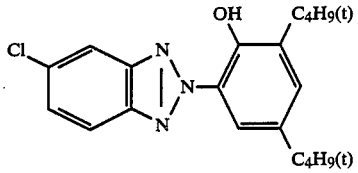
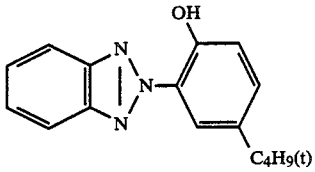
and
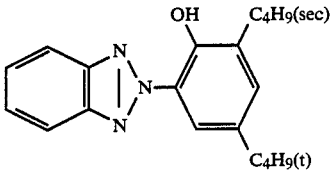
(m) Solvent
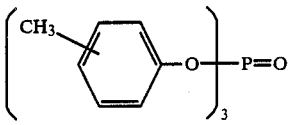

TABLE 1

| Layer | Main Ingredients | Amount used |
|---|---|---|
| 7th Layer (Protective layer) | Gelatin | 1.33 g/m$^2$ |
| | Acryl-denatured polyvinyl alcohol (denaturing degree: 17%) | 0.17 g/m$^2$ |
| 6th Layer (ultraviolet absorbing layer) | Gelatin | 0.54 g/m$^2$ |
| | Ultraviolet absorbent (h) | 0.21 g/m$^2$ |
| | Solvent (j) | 0.09 ml/m$^2$ |
| 5th Layer (Red-sensitive emulsion layer) | Silver chlorobromide emulsion* (Bromide content: 70 mol %) silver: | 0.26 g/m$^2$ |
| | Gelatin | 0.98 g/m$^2$ |
| | Cyan coupler (k) | 0.46 g/m$^2$ |
| | Dye image stabilizer (l) | 0.21 g/m$^2$ |
| | Solvent (m) | 0.28 ml/m$^2$ |
| 4th Layer (Ultraviolet absorbing layer) | Gelatin | 1.60 g/m$^2$ |
| | Ultraviolet absorbent (h) | 0.62 g/m$^2$ |
| | Color-mixing inhibitor (i) | 0.05 g/m$^2$ |
| | Solvent (j) | 0.26 ml/m$^2$ |
| 3rd Layer (Green-sensitive emulsion layer) | Silver chlorobromide emulsion* (Bromide content: 75 mol %) silver: | 0.16 g/m$^2$ |
| | Gelatin | 1.80 g/m$^2$ |
| | Magenta coupler (e) | 0.44 g/m$^2$ |
| | Dye image stabilizer (f) | 0.26 g/m$^2$ |
| | Solvent (g) | 0.88 ml/m$^2$ |
| 2nd Layer (Color-mixing inhibiting layer) | Gelatin | 0.99 g/m$^2$ |
| | Color-mixing inhibitor (d) | 0.08 g/m$^2$ |
| 1st Layer (Blue-sensitive emulsion layer) | Silver chlorobromide emulsion* (Bromide content: 80 mol %) silver: | 0.30 g/m$^2$ |
| | Gelatin | 1.86 g/m$^2$ |
| | Yellow coupler (a) | 0.82 g/m$^2$ |
| | Dye image stabilizer (b) | 0.19 g/m$^2$ |
| | Solvent (c) | 0.34 ml/m$^2$ |
| Support | Polyethylene-laminated paper (containing white pigment ($TiO_2$) and bluish pigment (ultramarine) in polyethylene laminate on the 1st layer side) | |

*A grain size and variation coefficient of each emulsion layer were as follows.

| | Grain Size | Variation Coefficient |
|---|---|---|
| Red-sensitive emulsion | 0.42 μm | 0.14 |
| Green-sensitive emulsion | 0.45 μm | 0.14 |
| Blue-sensitive emulsion | 1.01 μm | 0.08 |

The color paper shown in Table 1 was named Sample A. Samples B to E were prepared in the same manner as Sample A except that coverages of silver and amounts of coupler dispersions were so altered as shown in Table 2.

TABLE 2

| | A | B | C | D | E |
|---|---|---|---|---|---|
| Ag coverage (g/m$^2$) of red-sensitive emulsion layer | 0.26 | 0.31 | 0.30 | 0.30 | 0.31 |
| Ag coverage (g/m$^2$) of green-sensitive emulsion layer | 0.16 | 0.19 | 0.20 | 0.20 | 0.16 |
| Ag coverage (g/m$^2$) of blue-sensitive emulsion layer | 0.30 | 0.27 | 0.35 | 0.35 | 0.30 |
| Total Ag coverage (g/m$^2$) | 0.72 | 0.77 | 0.85 | 0.85 | 0.77 |
| Ag/Couper (mole ratio) in red-sensitive emulsion layer | 2.94 | 3.72 | 2.94 | 4.21 | 4.72 |
| Ag/Coupler (mole ratio) in green-sensitive emulsion layer | 2.96 | 5.72 | 2.96 | 5.72 | 5.72 |
| Ag/Coupler (mole ratio) in blue-sensitive emulsion layer | 2.72 | 2.50 | 2.72 | 2.72 | 4.80 |
| Note | Invention | Invention | Comparison | Comparison | Comparison |

Each of the above-described samples A to E was subjected to gradational exposure for sensitometry using a sensitometer (Model FWH, produced by Fuji Photo Film Co., Ltd.; Color temperature of light source: 3,200° K.) through each color filter, blue, green or red one. The exposure was carried out under conditions such that an exposure of 250 CMS was given to the sample within an exposure time of 0.5 second.

Thereafter, each sample was divided into two parts, and subjected to a photographic processing A using the following color developing solution (A) and a photographic processing B using the color developing solution (B) described below, respectively.

Each photographic processing consisted of color development, bleach-fix and washing steps. The developing time employed was 2 minutes. The photographic processings A and B differ only in formula of color developing solution used, and other contents are the same with the processing A as with the processing B.

| Processing Step | Temperature | Time |
|---|---|---|
| Development | 38° C. | 2.0 min. |
| Bleach-Fix | 38° C. | 1.0 min. |
| Washing | 28–35° C. | 3.0 min. |

Formula of Color Developing Solution A:

| | |
|---|---|
| Trisodium Nitrilotriacetate | 2.0 g |
| Benzyl Alcohol | 15 ml |
| Diethylene Glycol | 10 ml |
| $Na_2SO_3$ | 2.0 g |
| KBr | 1.0 g |
| Hydroxylamine Sulfate | 3.0 g |
| 4-Amino-3-methyl-N—ethyl-N—[β-(methanesulfonamido)ethyl]-p-phenylenediamine Sulfate | 5.0 g |
| $Na_2CO_3$ (monohydrate) | 30.0 g |
| Water to make | 1000 ml (pH 10.2) |

Formula of Color Developing Solution B:

| | |
|---|---|
| Trisodium Nitrilotriacetate | 2.0 g |
| $Na_2SO_3$ | 2.0 g |
| KBr | 1.0 g |
| Hydroxylamine Sulfate | 3.0 g |
| 4-Amino-3-methyl-N—ethyl-N—[β-methanesulfonamido)ethyl]-p-phenylenediamine Sulfate | 5.0 g |
| $Na_2CO_3$ (monohydrate) | 30.0 g |
| Water to make | 1000 ml (pH 10.2) |

Formula of Bleach-Fix Bath (common to Processings A and B):

| | |
|---|---|
| Ammonium thiosulfate (54 wt %) | 150 ml |
| $Na_2SO_3$ | 15 g |
| $NH_4[Fe(III)(EDTA)]$ | 55 g |
| EDTA.2Na | 4 g |
| Water to make | 1000 ml (pH 6.9) |

The results obtained are shown in Table 3 below. The sensitivities in the processing B are shown as relative values, with corresponding light-sensitive layers of the same sample in the processing A being taken as 100. The sensitivity therein was expressed in terms of a relative value of a reciprocal of an exposure required for producing a density of the minimum density +0.5. As a measure of the extent of decrease in color density of the developed image with respect to the processing employed, a color density of the developed image which was attained by carrying out optical exposure under such an exposure as to produce a color density of 1.5 through the processing A, and then carrying out the processing B was taken. Accordingly, the nearer to 1.5 the color density, the more efficient the color development of the photographic material.

TABLE 3

| Sample | Layer | Relative Sensitivity in Processing B | Color Density in Processing B (under such exposure as to produce color density of 1.5 in Processing A) | Note |
|---|---|---|---|---|
| A | Blue-sensitive | 95 | 1.46 | Invention |
| | Green-sensitive | 99 | 1.48 | Invention |
| | Red-sensitive | 98 | 1.48 | Invention |
| B | Blue-sensitive | 96 | 1.44 | Invention |
| | Green-sensitive | 93 | 1.42 | Invention |
| | Red-sensitive | 95 | 1.46 | Invention |
| C | Blue-sensitive | 82 | 1.05 | Comparison |
| | Green-sensitive | 85 | 1.20 | Comparison |
| | Red-sensitive | 84 | 1.15 | Comparison |
| D | Blue-sensitive | 82 | 1.05 | Comparison |
| | Green-sensitive | 79 | 1.00 | Comparison |
| | Red-sensitive | 80 | 0.95 | Comparison |
| E | Blue-sensitive | 69 | 0.96 | Comparison |
| | Green-sensitive | 83 | 1.02 | Comparison |
| | Red-sensitive | 79 | 1.15 | Comparison |

As can be seen from the data set forth in Table 3, the present samples A and B demonstrated as a result of the processing B, wherein benzyl alcohol was not used, excellent photographic characteristics near to those obtained by the processing A wherein benzyl alcohol was used. Namely, it is indicated that sufficiently high color density of image was obtained by the short-time development. On the other hand, the samples for comparison were shown to be unable to develop their colors with high efficiency by short-time development.

In accordance with the embodiments of the present invention, the load of environmental pollution can be reduced, labor for preparing the color developing solution can be saved, and a decrease in color density due to a cyan dye remaining in the form of leuco body can be prevented by substantially eliminating the used benzyl alcohol. Further, a large quantity of color paper can be processed rapidly, and thereby, productivity can be heightened with a leap. Furthermore, there can be provided color prints showing no more a light decrease in color density of the developed image even when receiving the short-time processing using a color developing solution substantially free from benzyl alcohol.

While the invention has been described in detail and with reference to specific embodiments thereof, it will be apparent to one skilled in the art that various changes and modifications can be made therein without departing from the spirit and scope thereof.

What is claimed is:

1. A method for forming a color image which comprises imagewise exposing a color photographic material containing a reflective support having thereon at least one blue-sensitive silver halide emulsion having 2 mol % or less iodide content and associated with a yellow dye-forming coupler, at least one green-sensitive silver halide emulsion layer having 2 mol % or less iodide content and associated with a magenta dye-forming coupler and at least one red-sensitive silver halide emulsion layer having 2 mole % or less iodide content and associated with a cyan dye-forming coupler wherein at least one of said blue-sensitive emulsion layer, at least one of said green-sensitive emulsion layer and at least one of said red-sensitive emulsion layer each contains said silver halide in a ratio of from 1/1 to 4.5/1 moles with respect to the color forming coupler and said photographic material has a total coverage of silver halide contained in all of said silver halide emulsion layers being controlled to 0.78 g/m$^2$ or less on a silver basis; and after imagewise exposure, developing said material within 2 minutes and 30 seconds with a color developing solution containing no more than 0.5 ml per liter of benzyl alcohol.

2. A method for forming a color image as in claim 1, wherein said at least one blue-sensitive emulsion layer, said at least one green-sensitive emulsion layer and said at least one red-sensitive emulsion layer each contains said silver halide in a molar ratio of from 1.5/1 to 3.5/1 with respect to the color-forming coupler.

3. A method for forming a color image as in claim 1, wherein said at least one blue-sensitive emulsion layer, said at least one green-sensitive emulsion layer and at least one red-sensitive emulsion layer each contains said silver halide in a molar ratio of from 2/1 to 3/1 with respect to the color-forming coupler.

4. A method for forming a color image as in claim 1, wherein the total coverage of silver halide contained in said silver halide emulsion layers is 0.72 g/m$^2$ or less on a silver basis.

5. A method for forming a color image as in claim 4, wherein the silver coverage of each light-sensitive layer is within a range of from 0.15 to 0.35 g/m$^2$.

6. A method for forming a color image as in claim 1, wherein said silver halide emulsion is a monodispersed emulsion having a variation coefficient of 0.2 or less and a mean grain size of from 0.2 to 1.5 microns.

7. A method for forming a color image as in claim 6, wherein said silver halide emulsion has a variation coefficient of 0.15 or less.

8. A method for forming a color image as in claim 1, wherein the green-sensitive silver halide emulsion and the red-sensitive silver halide emulsion are each a monodispersed emulsion having a variation coefficient of 0.15 or less and a mean grain size of from 0.2 to 0.6 microns and the blue-sensitive silver halide emulsion is the above-said monodispersed emulsion having a mean grain size of 0.6 to 1.3 microns.

9. A method for forming a color image as in claim 1, wherein the silver halide emulsion layers each contains silver halide grains having a regular crystal form.

10. A method for forming a color image as in claim 9, wherein the silver halide emulsion layers each contains silver halide grains having a cubic form.

11. A method for forming a color image as in claim 1, wherein the silver halide emulsion layers each contains silver halide grains having a core/shell structure and predominantly forming a latent image on the surface of the silver halide grains upon exposure to light.

12. A method for forming a color image as in claim 1, wherein the silver halide is a silver chlorobromide having from 20 mol % to 98 mol % of bromide content.

13. A method for forming a color image as in claim 1, wherein the silver halide is silver chloride or silver chlorobromide having the chloride content of more than 80 mol %.

14. A method for forming a color image as in claim 13, wherein the silver chlorobromide has 90 mol % more of chloride content.

15. A method for forming a color image as in claim 1, wherein the yellow dye, the magenta dye and the cyan dye are formed by a coupling reaction of the couplers with an oxidation product of an aromatic primary amine color developing agent.

16. A method for forming a color image as in claim 15, wherein the aromatic primary amine color developing agent is p-phenylenediamine derivatives.

17. A method for forming a color image as in claim 16, wherein the p-phenylenediamine derivatives are 3-methyl-4-amino-N-ethyl-N-β-hydroxyethylaniline or 3-methyl-4-amino-N-ethyl-N-β-methanesulfonamidoethylaniline.

18. A method for forming a color image as in claim 17, wherein the p-phenylenediamine derivatives is 3-methyl-4-amino-N-ethyl-N-β-methanesulfonamidoethylaniline.

19. A method for forming a color image as in claim 1, wherein the color photographic material is developed within 2 minutes and 10 seconds.

20. A method for forming a color image as in claim 1, wherein the color developing solution is free from benzyl alcohol.

21. A method for forming a color image as in claim 1, wherein the silver halide predominantly forms a latent image on the surface thereof upon exposure to light.

22. A method for forming a color image as in claim 1, wherein the green-sensitive silver halide emulsion and the red-sensitive silver halide emulsion are each a monodispersed emulsion having a variation coefficient of 0.15 or less and a means grain size of from 0.2 to 0.6 microns and the blue-sensitive silver halide emulsion is the above-said monodispersed emulsion having a mean grain size of 0.6 to 1.3 microns, further wherein any silver halide is silver chloride or silver chlorobrobromide having a silver chloride content of more than 80 mol %.

23. A method for forming a color image as in claim 22, wherein the silver halide is silver chlorobromide which has 90 mol % or more of chloride content.

* * * * *